US006295847B1

(12) United States Patent
Zeren

(10) Patent No.: US 6,295,847 B1
(45) Date of Patent: Oct. 2, 2001

(54) CABLE LOCKING DEVICE

(75) Inventor: Gregory Zeren, Sunnyvale, CA (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/426,066

(22) Filed: Oct. 22, 1999

(51) Int. Cl.[7] ..... E05B 69/00
(52) U.S. Cl. ..... 70/58; 70/18; 70/49
(58) Field of Search ..... 70/14, 18, 19, 70/30, 49, 57, 58

(56) References Cited

U.S. PATENT DOCUMENTS 4,733,840 * 3/1988 D'Amore ..... 70/18 X
5,076,079 * 12/1991 Monoson et al. ..... 70/58
5,351,507 * 10/1994 Derman ..... 70/58 X
5,398,530 * 3/1995 Derman ..... 70/18 X
5,579,657 * 12/1996 Makous ..... 70/18 X
5,875,657 * 3/1999 Kelley ..... 70/18
5,937,678 * 8/1999 Kuo ..... 70/58 X
5,974,840 * 11/1999 Kao ..... 70/18 X
6,000,251 * 12/1999 Murray, Jr. et al. ..... 70/18 X
6,003,348 * 12/1999 McCrea ..... 70/58 X
6,006,555 * 12/1999 Shu-Fen ..... 70/58 X

* cited by examiner

*Primary Examiner*—Suzanne Dino Barrett
(74) *Attorney, Agent, or Firm*—McGutchen, Doyle, Brown & Enersen, LLP

(57) ABSTRACT

A device for coupling a cable to a locking member provided at an end of the cable. A coupling device includes a slot portion provided with a slot for receiving the locking member, and at least one cable portion that extends from the slot portion, the cable portion being formed with an opening for receiving passage of the cable therein. An object that includes an opening or passage may receive the cable for being secured thereby.

8 Claims, 5 Drawing Sheets

CABLE LOCKING DEVICE

BACKGROUND OF THE INVENTION

Theft of portable objects is an eternal concern. Various locking devices exist to combat the problem of theft of portable objects. The assignees of the present invention, Acco Brands, Inc., has developed proprietary security slots, which are found on many portable electronic devices such as laptop computers. U.S. Pat. Nos. 5,327,752 and 5,381,685, for example, also assigned to Acco Brands, Inc., describe a line of cable-attaching locking devices designed for interfacing with portable equipment provided with a security slot like that mentioned above. In one example of a locking device, a locking mechanism attaches a cable to a portable electronic device, whereby the cable may be attached to an object other than the portable electronic device to inhibit its theft.

Not all portable objects are designed to include a security slot. However, there is a need for a system by which a cable is used to secure an object lacking a security slot. Further, such a system should be adapted for use with cable lock devices currently available in the market, such as those described above.

SUMMARY OF THE INVENTION

The present invention provides an interface adapted for use with a cable locking device, to secure an end of a cable to another portion of the cable in a loop. An advantage of the present invention is to provide a security system that takes advantage of cable locking devices available in the market in order to secure a portable object through use of a passage through which a cable may be placed.

In one aspect of the invention, a cable self-coupling device includes a slot portion provided with a slot for coupling with the locking member, and a first cable portion that extends from a side of the slot portion and includes a first opening through which the cable is passed. In another aspect of the invention, the cable self-coupling device includes a second cable portion that also includes an opening through which the cable is passed. The second cable portion extends from an opposite side of the slot portion as the first cable portion.

In another aspect of the invention, a system for maintaining a cable in a loop is provided. The system includes a locking device coupled to a first end of the cable, where the locking device includes a locking member being movable from an unlock position to a lock position. The system further includes a coupling device having a slot portion and a cable portion. The slot portion is provided with a slot for receiving the locking member in the unlock position and for coupling with the locking member in the lock position. The cable portion extends from a side of the slot portion, and includes a first opening through which a second end of the cable is passed to provide a loop in the cable between the first end and the second end.

In yet another aspect of the invention a method of securing an object having a passage is provided. The method includes providing a coupling device to an intermediate portion of a cable, the coupling device including a slot portion provided with a slot and at least one cable portion that extends from a side of the slot portion, the at least one cable portion including a hole corresponding to a diameter of said cable for receiving the intermediate portion of the cable. The method further includes passing an end of the cable through said passage, wherein the cable end includes a locking member, looping the end of the cable toward the coupling device, and engaging the locking member to the slot of the slot portion of the coupling device to secure the object with the cable.

In another aspect of the invention, a method of maintaining a cable in a security loop is provided. The method includes providing a locking device at one end of the cable, and passing the locking device through a cable portion of a coupling device so that a portion of the cable also passes through the cable portion. The method further includes forming the passed portion of the cable into a loop so that the locking device is directed back toward the coupling device, and engaging the locking device to a slot portion of the coupling device, where the slot portion includes a slot for receiving a locking member provided on the locking device.

In still yet another aspect of the invention, a device for coupling a cable to a locking device provided at an end of the cable, where the locking device includes a locking member, is provided. The device includes a cable attachment portion having an opening through which the cable is passed, and a locking member attachment portion that extends from the cable attachment portion. The locking member attachment portion includes a slot adapted for receiving the locking member.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

The preferred embodiments of this invention, illustrating all their features, will now be discussed in detail. These embodiments depict the novel and nonobvious locking apparatus of this invention shown in the accompanying drawings, which are included for illustrative purposes only. These drawings include the following figures, with like numerals indicating like parts.

DETAILED DESCRIPTION OF THE SPECIFIC EMBODIMENTS

Figure 1:
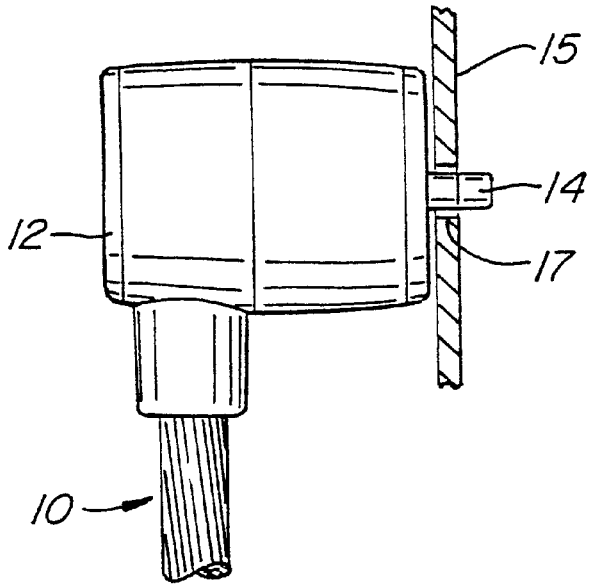
FIG. 1. (PRIOR ART)
FIG. 1 shows a locking device adapted for use with embodiments of the present invention.

FIG. 1 is an example of a cable locking device designed for interfacing with portable equipment provided with a security slot, such as described in U.S. Pat. Nos. 5,327,752 and 5,381,685, for example, owned by Acco Brands, Inc., the assignee of the present invention. A locking device 12 is coupled to a cable 10. The device shown in FIG. 1 is designed to interface with and engage a wall 15 that includes a security slot 17. The locking device includes a locking member 14 that is movable between an unlock position and a lock position. In an unlock position, locking member 14 is insertable into and removable from security slot 17.

Figure 2:
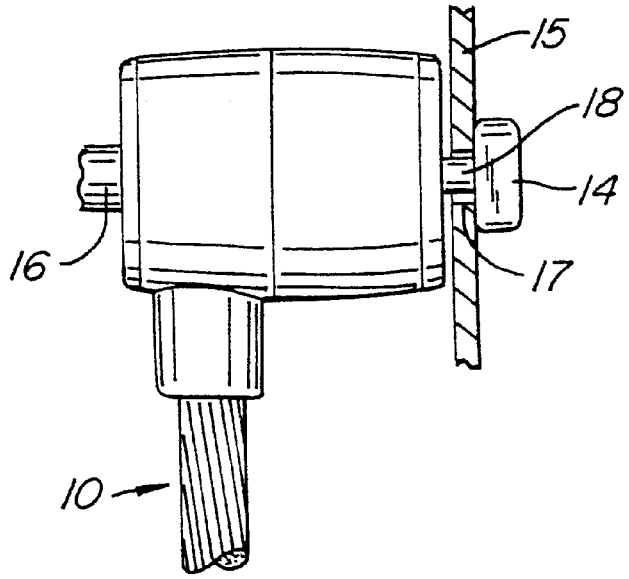
FIG. 2. (PRIOR ART)
FIG. 2 shows a locking device of FIG. 1 in a lock position.

FIG. 2 illustrates the locking device 12 with the locking member 14 in a lock position. In the lock position, locking member 14 extends into the slot by an engagement member 18 and engages an interior portion of wall 15. Thus engaged, the locking member is inhibited from removal from slot, and the locking device is secured to the wall. With cable 10 fixedly attached to the locking device, any device having a wall containing a slot as described may be secured to a theft-inhibiting cable.

Figure 3:
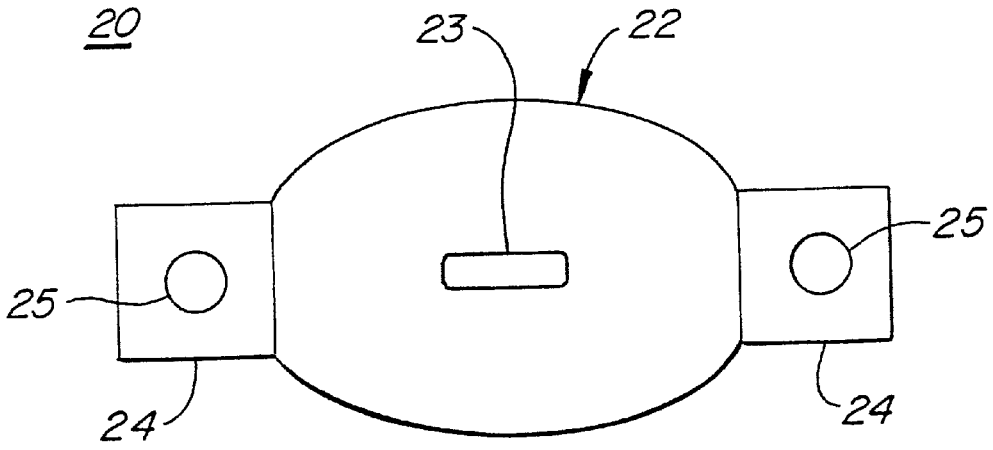
FIG. 3 is a plan view of a coupling device according an embodiment of the present invention.

With reference to FIG. 3, there is shown an exemplary embodiment of a coupling device 20 according to the present invention. Coupling device 20 includes a slot portion 22 that is provided with a security slot 23. In a preferred embodiment, security slot 23 is rectangular having dimensions of 3 mm in width and 7 mm in length. In alternative embodiments, however, the security slot can be rounded, or can be multi-lobular in shape. Preferably, the security slot 23 is positioned approximately in the middle of slot portion 22. Extending from the slot portion 22 are cable portions 24. Cable portion 24 includes an area that defines an opening 25. The opening is adapted to accommodate the cross-sectional dimensions of a cable 10. It should be understood that opening 25 could be adapted or sized to accommodate any size cable.

In a preferred embodiment, slot portion 22 and each cable portion 24 are constructed of a highly rigid material such as metal. Also in a preferred embodiment, the slot portion and cable portion are planar, so as to be easily constructed from a single piece of rigid material and effectively accommodate the locking device as described above with reference to FIG. 2.

Figure 4:
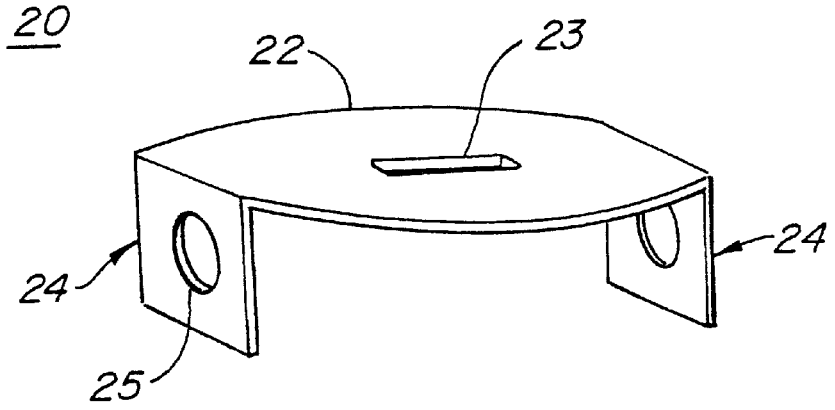
FIG. 4 is a perspective view of the coupling device of FIG. 3 in an alternative engagement configuration according to the present invention.

FIG. 4 shows coupling device 20 in operation to illustrate engagement with a cable. In an exemplary embodiment, each cable portion 24 is bent away from the plane of slot portion 22. In a preferred embodiment, the cable portion and the slot portion converge at approximately 90° from each other. In a bent position, openings defined in the cable portions are positioned at a right angle from a slot defined in the slot portion. A cable can be passed through both openings 25, and is looped around so that a locking device on the cable 10 engages the security slot 23 in slot portion 22 to maintain the cable in a loop.

Figure 5:
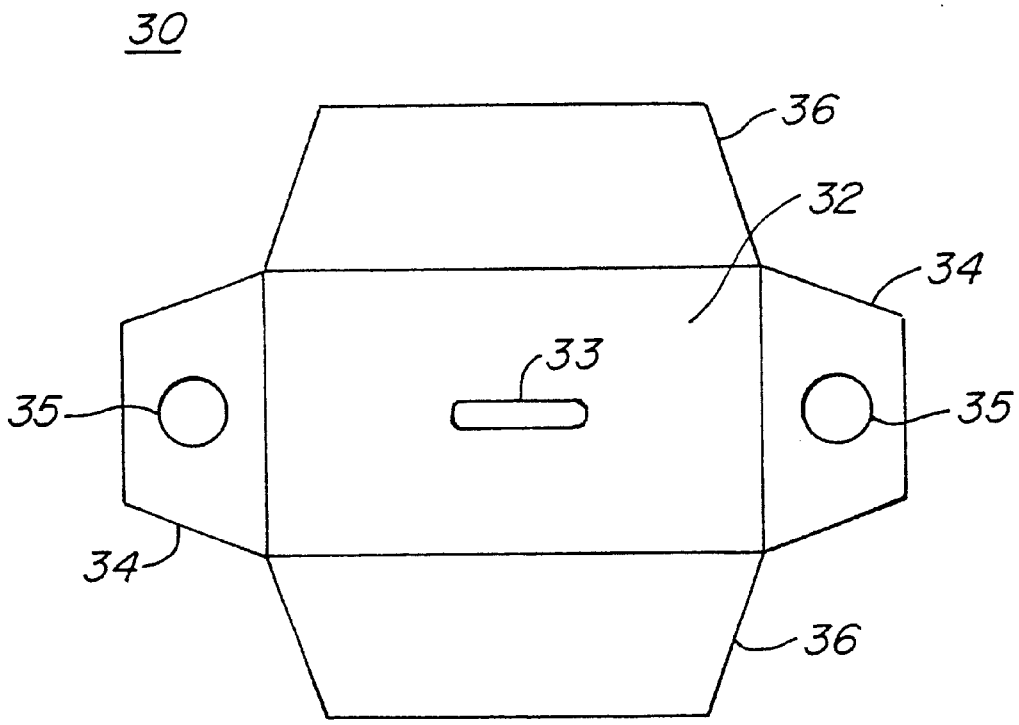
FIG. 5 is a plan view of a coupling device according to an alternative embodiment of the present invention.

FIG. 5 shows an alternative exemplary embodiment of the present invention. A coupling device 30 includes a slot portion 32, and a cable portion 34 extending from slot portion 32. In the embodiment shown in FIG. 5, coupling device 30 also includes a side portion 36 also extending from slot portion 32. In a preferred embodiment, the cable portions 34 extend from opposite ends of the slot portion, and the side portions 36 extend from opposite sides of the slot portion. Slot portion 32 is provided with a security slot 33, as was described in reference to FIG. 3. Each cable portion 34 is provided with an opening 35 that is sized and adapted for being slightly larger than a cross-sectional dimension of cable 10. However, in an alternative embodiment, the opening is sized so as to allow passage of the locking device therethrough.

Figure 6:
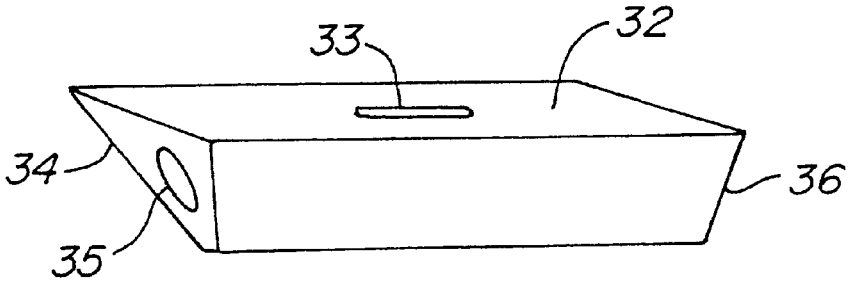
FIG. 6 is a perspective view of the coupling device of FIG. 5 in an alternative engagement position according to the present invention.

FIG. 6 shows the coupling device of FIG. 5 in a specific operational position. Each cable portion 34, and each side portion 36, is bent down from the plane of slot portion 32. Sides of each side portion 36 join with sides of respective cable portions 34 when bent away from slot portion 32. In this position, a locking member that is passed through slot 33 is protected from unauthorized access.

Figure 7:
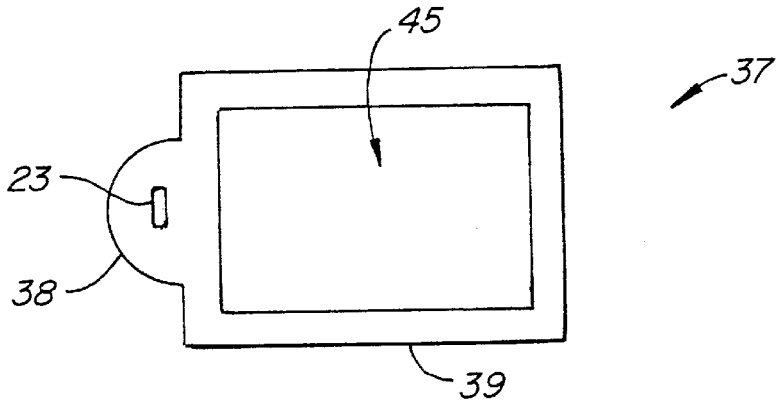
FIG. 7 is a plan view of a coupling device according to a second alternative embodiment of the present invention.

FIG. 7 shows a plan view of another alternative embodiment of a coupling device 37 according to the present invention. Coupling device 37 includes a slot portion 38 that protrudes from a periphery of a cable portion 39. The cable portion extends from one side of the slot portion. The cable portion shown in FIG. 7 is preferably rectangular in shape and a major portion of the interior of the cable portion is preferably an opening 45.

Figure 8:
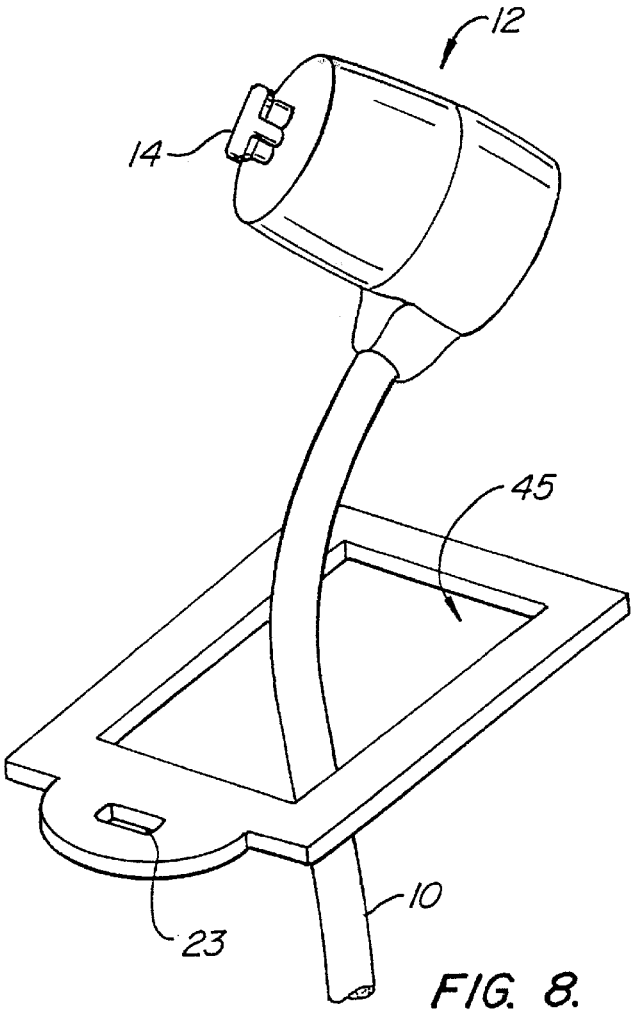
FIG. 8 is a perspective view of the coupling device of FIG. 7 in relation with a locking device.

FIG. 8 shows a perspective view of coupling device 37 in relation with a locking device 12. In a preferred embodiment, opening 45 is large enough so that the locking device may be threaded through it and pull a cable through also. In operation, the locking device is threaded through the opening and the cable is placed in a loop. The locking device includes a locking member that couples to a slot 23 provided in the slot portion.

Figure 9:
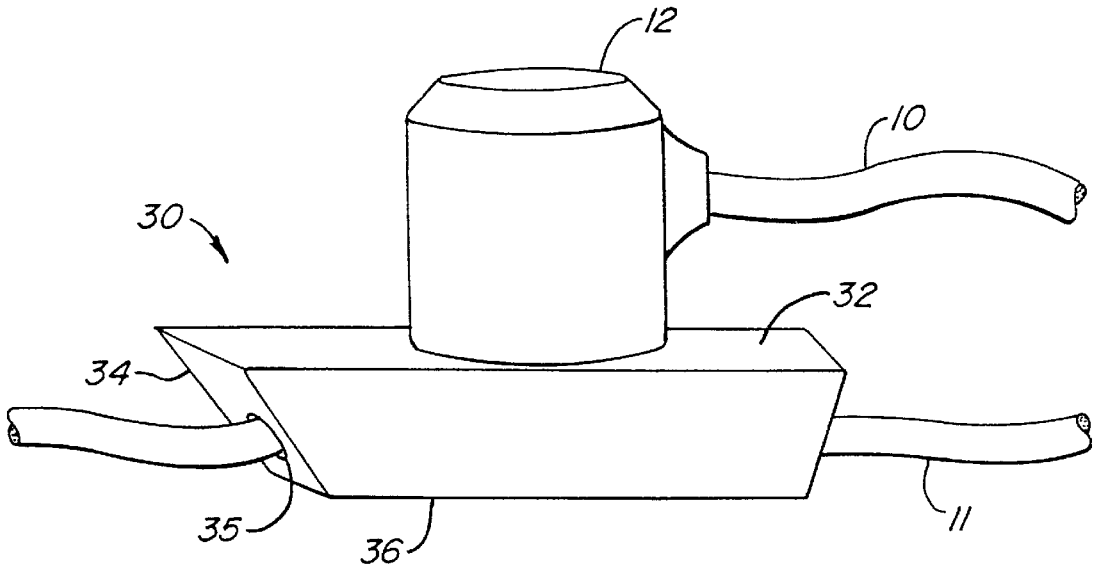
FIG. 9 illustrates a locking system and operation according to an embodiment of the invention.

FIG. 9 illustrates the operation of a security system according to an embodiment of the invention. FIG. 9 shows a coupling device 30, as was described above in reference to FIG. 6. In the position illustrated, an intermediate portion 11 of cable 10 is passed through openings 35 in each cable portion 34. The cable 10 is looped around (not shown), wherein a locking device 12, provided at an end of the cable 10, engages with a slot provided in slot portion 32. In this way, coupling device 30 provides an interface to lock an end of a cable 10 to itself.

Figure 10:
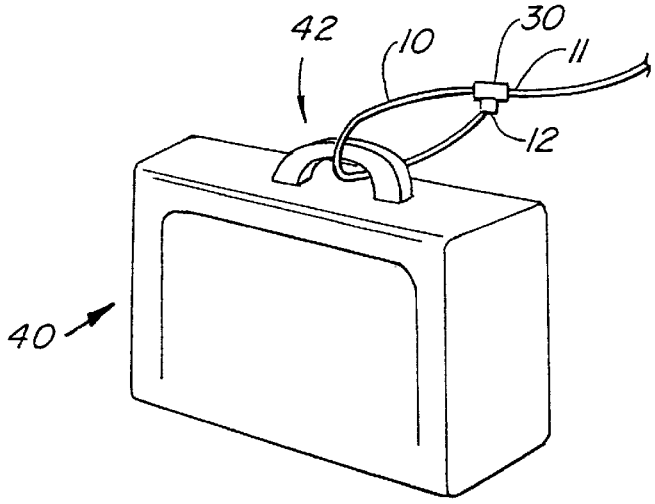
FIG. 10 illustrates operation of a locking system according to the present invention to secure an object.

With reference to FIG. 10, a system and method of securing an object using the principles of the present invention is illustrated. An object 40 includes a passage 42. A passage may be formed by a handle on a piece of luggage, for example, or may be an aperture formed in a wall of the object 40. A locking device 12 is provided at an end of a cable 10. The cable is passed through the passage 42 and looped around toward an intermediate portion 11 of the cable. A coupling device 30, according to the embodiments described above, is positioned on the intermediate portion of the cable. The locking device 12 engages with the coupling device 30 as described above. The loop of the cable 10 may be made wider or narrower depending upon the preferred location of coupling device 30. When in a locked position, the coupling device 30 and locking device 12 secure the cable 10 in a looped position through passage 42, such that the object 40 is inhibited from asportation or theft.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A device for coupling a cable to a locking member provided at an end of the cable, the device comprising:

a slot portion provided with a slot for coupling with said locking member; and a first cable portion that extends from a side of the slot portion and includes a first opening adapted for receiving said cable, wherein the slot portion and the cable portion are planar.

2. A device for coupling a cable to a locking member provided at an end of the cable, the device comprising:

a slot portion provided with a slot for coupling with said locking member; and a first cable portion that extends from a side of the slot portion and includes a first opening adapted for receiving said cable, wherein the first cable portion is bent away from a plane of the slot portion.

3. A device for coupling a cable to a locking member provided at an end of the cable, the device comprising:

a slot portion provided with a slot for coupling with said locking member; and a first cable portion that extends from a side of the slot portion and includes a first opening adapted for receiving said cable;

a second cable portion that extends from an opposite side of the slot portion and includes a second opening adapted for receiving said cable; and two side portions that extend from opposing sides of the slot portion at a substantially right angle from the first and second cable portions, wherein the two side portions are bent away from a plane of the slot portion.

4. The device as recited in claim 1 wherein the slot portion and the first cable portion are formed in the same plane.

5. A security system, comprising:

a cable;

a locking device attached to the cable, the locking device including a locking member being movable from an unlock position to a lock position; and a coupling device, including a slot portion provided with a slot for receiving the locking member in the unlock position and coupling with the locking member in the lock position; and a first cable portion that extends from a side of the slot portion, the cable portion including a first opening through which the cable is passed, wherein the slot portion and the cable portion are planar.

6. A method of securing an object having a passage, the method comprising the steps of:

providing a coupling device to an intermediate portion of a cable, the coupling device including a slot portion provided with a slot and at least one cable portion that extends from a side of the slot portion, the at least one cable portion including a hole corresponding to a diameter of said cable for receiving the intermediate portion of the cable;

passing an end of the cable through said passage, wherein the cable end includes a locking member;

looping the end of the cable toward the coupling device;

engaging the locking member to the slot of the slot portion of the coupling device to secure the object with the cable; and bending each cable portion and a pair of opposing side portions so as to inhibit access to the engagement of the locking member in the slot.

7. A device for coupling a cable to a locking device provided at an end of the cable, the locking device including a locking member, the device comprising:

a cable attachment portion having an opening through which said cable is passed; and a locking member attachment portion that extends from the cable attachment portion, the locking member attachment portion including a slot adapted for receiving said locking member, wherein the cable attachment portion and the locking member attachment portion are planar.

8. The device as recited in claim 7 wherein the locking member attachment portion extends within the same plane as the cable attachment portion.

* * * * *